United States Patent [19]

de Nora et al.

[11] Patent Number: 4,869,799

[45] Date of Patent: Sep. 26, 1989

[54] MEMBRANE CELL FOR THE ELECTROLYSIS OF ALKALI METAL CHLORIDE AND PROCESS THEREOF

[76] Inventors: Oronzio de Nora, Piazza della Republica 19, 20124 Milan; Antonio Nidola, Via Farnetti 5, 20129 Milan, both of Italy

[21] Appl. No.: 60,548

[22] Filed: Jun. 11, 1987

Related U.S. Application Data

[63] Continuation-in-part of Ser. No. 421,536, Sep. 22, 1982, abandoned.

[30] Foreign Application Priority Data

Oct. 7, 1981 [IT] Italy ..... 24386 A/81

[51] Int. Cl.[4] ..... C25B 9/00

[52] U.S. Cl. ..... 204/252; 204/128; 204/283

[58] Field of Search ..... 204/252, 283, 282, 290 R, 204/291, 294, 295, 253, 254, 255, 256, 257, 258, 98, 128

[56] References Cited

U.S. PATENT DOCUMENTS 21735,812 2/1956 Van Hoek ..... 204/301
4,381,979 5/1983 de Nora et al. ..... 204/128

FOREIGN PATENT DOCUMENTS 2064586 6/1981 United Kingdom ..... 204/252

*Primary Examiner*—John F. Niebling
*Assistant Examiner*—Kathryn Gorgos
*Attorney, Agent, or Firm*—Pollock, Vande Sande & Priddy

[57] ABSTRACT

In a process for the electrolysis of alkali metal chloride conducted in a cell comprising a porous, gas and liquid permeable anode and a porous, gas and liquid permeable cathode separated by an ion exchange polymeric membrane impervious to the hydrodynamic flow, wherein the electrodes are in contact or in any way close to the membrane surface in order to reduce the interelectrodic gap, the insertion of a thin porous sheet, fluid permeable and highly hydrophilic, between the membrane and the cathode surfaces, allows for the considerable reduction of the cell voltage.

10 Claims, No Drawings

MEMBRANE CELL FOR THE ELECTROLYSIS OF ALKALI METAL CHLORIDE AND PROCESS THEREOF

CROSS-REFERENCE TO RELATED APPLICATION

This is a continuation-in-part application of Ser. No. 421,536, filed on Sept. 22, 1982 now abandoned and entitled "Membrane Cell for the Electrolysis of Alkali Metal Chloride and Process Thereof", entire disclosure of which is incorporated herein by reference.

The present invention concerns an improved electrolysis cell comprising an ion exchange polymeric membrane for the electrolysis of alkali metal chloride in aqueous solutions.

As is well known to the expert of the art, the recent possibility to use efficacious and durable ion-exchange polymeric membranes instead of conventional porous asbestos diaphragms has brought about a real revolution in cell configuration. In particular, in conventional diaphragm cells the anode and the cathode were kept a certain distance apart, as this distance, however little (from 2 to 4 mm), which was considered instrumental in avoiding short-circuits. In modern membrane cells there is a strong tendency to reduce this gap to the thickness of the membrane itself, that is the anode and the cathode, obviously consisting of fluid-permeable reticulated structures, are put into contact, or quite so, with the membrane itself.

Resilient elements have been proposed which substantially provide for the membrane to be resiliently pressed between the electrodes, after assembly of the cell (see, for example, U.S. Pat. No. 4,340,452).

Polymeric membranes used for this purpose typically consist of fluorocarbon polymers such as a polymer of an unsaturated fluorocarbon. For example, polymers of trifluoroethylene or tetrafluoroethylene or copolymers thereof which contain ion exchange groups are used for this purpose. The ion exchange groups normally are cationic groups including sulfonic, sulfonamide, carboxylic, phosphoric groups and the like, which are attached to the fluorocarbon polymer chain through carbon and which will exchange cations. However, they may also contain anion exchange groups. Thus, they have the general structure:

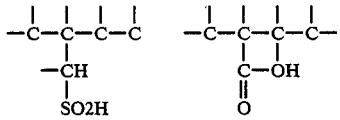

Typically such membranes are those manufactured by the Du Pont Company under the trade name of "Nafion" and by Asahi Glass Co. of Japan under the trade name of "Flemion". Patents describing such membranes include British No. 1,184,321 and U.S. Pat. Nos. 3,282,875 and 4,075,405.

Since these diaphragms are ion permeable but do not permit anolyte flow therethrough, little or no chloride ions migrate through the diaphragm of such a material in an alkali metal chloride cell and, therefore, the alkali thus produced contains few chloride ions. Furthermore, it is possible to produce a more concentrated alkali metal hydroxide wherein the catholyte produced may contain from 15 to 40% of NaOH by weight or even higher. Patents describing such a process include U.S. Pat. Nos. 4,111,779 and 4,100,050 and many others. The application of an ion exchange membrane as an ion permeable diaphragm has also been proposed for other uses, such as in water electrolysis.

Notwithstanding continuous improvements achieved as regards reduction of the cell voltage by reducing the electrical resistance and increase of the faradic efficiency of the electrolysis process obtained by increasing ion permselectivity, the membrane is still adversely affected by an intrinsic characteristic which causes a considerable ohmic drop in the electrolysis process. In fact, the membrane surface exposed to the catholyte, which typically consists of an aqueous solution of soda or potash having a concentration generally composed between 20 and 35% by weight, is easily wettable by the gaseous hydrogen evolved at the cathode. Said hydrogen acts as an insulating film and thus increases the ohmic drop and greatly contributes to keep a high cell voltage in spite of the progress achieved in improving the chemical structure of the membrane, to increase its conductivity.

Said drawback may be overcome by resorting to an electrodic structure as described in U.S. Pat. No. 4,340,452 which allows for obtaining improved cell voltages by providing for a multiplicity of contact points between the electrodes and the membrane.

A different method for overcoming the above mentioned shortcoming of the prior art consists in modifying the ion exchange membrane, as described in U.K. Publication GB No. 2,064,586, by providing for a porous superficial layer bonded thereto and containing particulate late inert, non-hydrophobic material, thus increasing the wettability of the membrane by alkali metal hydroxide solutions. Said bonded porous layer according to U.K. Publication GB No. 2,064,586 may be obtained either by means of a polymeric binder mixed with the non-hydrophobic particles or by embedding said non-hydrophobic particles directly onto the membrane surface. In both instances the porous layer cannot be made entirely non-hydrophobic because either the polymeric binder used or the exposed portion of the ion exchange resin, in which the particles are embedded, are essential components of the porous layer which is readily filmed by the hydrogen and which still imparts a significant hydrophobicity to the exposed surface of the modified membrane.

It has been surprisingly found by the inventors of the present application that by introducing, between the membrane and the cathode surfaces, a thin, permeable porous sheet, highly hydrophilic and substantially non conductive, the cell voltage is further reduced with respect to the prior art teachings of U.S. Pat. No. 4,340,452 and U.K. Publication GB No. 2,064,586. Substantially, operating at 3 kA/m2, a cell voltage reduction in the order of 0.6 V with respect to the use of commercial untreated membranes, is obtained. Furthermore, by the present invention, a reduction in the order of 0.1 V is obtained compared with the best results achieved by resorting to the teachings of U.K. Publication GB No. 2,064,586, which means that a saving in the electric power consumption of about 3% is attained.

The permeable, hydrophilic and substantially non-conductive sheet has a small thickness, generally comprised between 50 and 500 micrometers, and is highly permeable to fluids. At least its surface consists of a highly hydrophilic material, which does not permit hydrogen discharge. A non-conductive or highly resistant material, wettable and stable in caustic solution, is most suitable for this purpose. Typical examples of suitable materials are: CaO, BaO, SrO, Y2O3, La2O3, CeO2, PrO2,NdO2, TiO2, ZrO2, HfO2, ThO2, V2O5, Nb2O5, Ta2O5, MoO3, WO3, CdO, Al2O3, SiO2, mixed oxides of the same metals, amorphous carbon, graphite and asbestos.

The thin, porous, permeable sheets may be constituted by one of the above mentioned materials or by mixtures of the same, suitably formed by aggregation and/or sintering or by means of a suitable polymeric binder. The permeability and porosity of the sheets may be improved by mixing to the powders of the aforesaid materials, before forming, the powder of a leachable metal or salt, such as Al, Zn or Sn, which is then leached, for example, with caustic soda, thus increasing the porosity of the aggregate.

Otherwise, the porous sheet may be constituted by a suitable metallic support, such as for example a fine screen made of nickel, copper or stainless steel, coated according to suitable techniques with a highly hydrophilic material exhibiting a very high electrical resistivity and withstanding the caustic solution conditions. According to this most preferred embodiment of the invention, structures are provided which withstand mechanical stress and can be easily handled since the core or substrate metal fine screen gives to the structure an optimum mechanical resistance, while the coating gives to the surface the necessary inert characteristics with respect to hydrogen discharge and hydrophilic properties. A porous sheet being substantially nonconductive and easily wettable by the catholyte is thus obtained. A further advantage of this embodiment is represented by the fact that by suitably selecting the fine screen characteristics, that is the number of meshes per unity of length and the wire diameter (that is the ratio empty/full spaces) both the porosity and the sheet thickness are easily optimizable. Porosity and thickness are two important characteristics of the hydrophilic and electrically inert sheet. The average pore size should be comprised between 300 and 10 micrometers and the thickness of the thin porous sheet should not be greater than 1 millimeter and preferably comprised between 0.1 and 0.6 millimeters.

According to another embodiment of the invention, the hydrophilic layer, electrochemically inert to hydrogen discharge, may be directly applied onto the cathode structure, that is said layer is applied only onto one of the surfaces of the cathodic screen, which is then turned towards the membrane. The opposite surface of the cathodic screen still retains its electrocatalytic properties and constitutes the cathodic surface wherein hydrogen is evolved.

Although the coating may be applied through various techniques, it has been found extremely advantageous to coat the fine screen with the hydrophilic and nonconductive material through plasma jet deposition, that is the powder of the coating material, or mixture thereof, are sprayed onto the supporting screen by means of a plasma jet torch.

The improved cell of the present invention is therefore constituted, in its essential parts, by an anode, a polymeric ion-exchange membrane, a thin, fluid permeable, highly hydrophilic and electrochemically inert porous sheet and a cathode arranged according to this sequence.

The anode is preferably constituted by an expanded mesh or perforated sheet made of titanium or other valve metal coated at least on one of its surfaces by an electrocatalytic deposit comprising at least a noble metal such as ruthenium, platinum, iridium or oxides or mixed oxides thereof.

The membrane consists of a thin polymeric sheet made of a polymer containing ion exchange fixed functional groups.

The porous, fluid permeable, highly hydrophilic and electrochemically inert thin sheet may be constituted, according to alternative embodiments of the present invention, by:

(a) a porous sheet obtained by sintering and/or aggregating by means of suitable binder powders of the materials previously illustrated (b) a metal fine screen support made of nickel, copper or stainless steel, coated by the aforesaid materials;

(c) a porous deposit of the aforesaid materials applied on the cathodic mesh surface, facing the membrane.

The cathode is preferably constituted by a mesh or expanded sheet or perforated sheet made of a metal resistant to the cathodic conditions, such as nickel, iron, copper and stainless steel, preferably activated by means of a deposit exhibiting low hydrogen overvoltage, which may comprise, for example, ruthenium, palladium or platinum or oxides thereof.

A most preferred embodiment of the cell is described in U.S. Pat. Nos. 4,343,600 and 4,340,452, by the applicant, and a description of the same is herewith incorporated by express reference.

In the above mentioned cell, the membrane is resiliently pressed between the anode, substantially rigid, and the cathodic structure, which comprises a resilient layer of a metal wire which is compressed after assembly of the cell.

The porous, fluid-permeable, highly hydrophilic and electrochemically inert porous sheet may be easily interposed between the membrane and the resilient cathodic structure, then by the pressure applied after assembly of the cell, the porous sheet results in being compressed between the membrane surface and the cathode.

The same embodiment of the cell described in the above mentioned patents is useful also in case the porous hydrophilic and electrochemically inert sheet is applied on the surface facing the membrane on the cathode screen. In this case, the cathode screen wherein the deposit of hydrophilic and electrochemically inert material has been applied on the surface directly facing the membrane, is pressed against the membrane by the resilient layer, Therefore, the hydrophilic, nonconductive, porous sheet of the present invention is inserted between the membrane surface and the cathode surface.

In order to better illustrate the invention, some examples of typical embodiments of the present invention are reported herewith.

EXAMPLE 1

Powders of aluminum amorphous carbon and quartz (SiO2) having a grain size comprised between 90 and 170 micrometers, have been mixed with the powder of a polymer of vinylidene fluoride, known under the commercial name of KYNAR (R), produced by Pennwalt Corporation, according to the following ratio:

| | |
|---|---|
| Al | 25% |
| $SiO_2$ | 25% |
| C | 25% |

-continued

| | |
|---|---|
| KYNAR(R) | 25% |

The mixture has been pressed in a mold at a pressure of 2000 Kg/cm2 and a temperature of about 200° C. for 5 seconds obtaining a thin sheet about 200 micrometers thick.

The sheet has been soaked for two hours in caustic soda at 20% by weight, in order to dissolve all the aluminum. The porosity of the sheet was established to be about 40% with an average pore diameter of about 70 micrometers. A laboratory cell has been provided, having an electrodic surface of 14 cm2.

The cell anode consisted of a titanium expanded sheet having a thickness of 1.5 mm, coated with mixed oxides of Ru(50%) and Ti(50% by weight).

The membrane consisted of a hydrated polymeric sheet having an average thickness of about 0.4 mm, comprising a layer of a fluorinated polymer containing sulphonic groups on the surface exposed to the anolyte, and a layer of a fluorinated polymer containing carboxylic groups on the surface exposed to the catholyte, and a Teflon mesh interposed between the two layers during lamination as a mechanical reinforcement.

The cathode consisted of a thin nickel screen having 20 meshes per cm. knitted with a wire having a diameter of 0.15 mm, activated with a galvanic coating of Ru (50% by weight) and Ni (50% by weight), with a thickness of some micrometers and by a resilient layer consisting of some micrometers and by a resilient layer consisting of three superimposed layers of undulated mesh knitted with a nickel wire having a diameter of 0.15 mm and a current collecting expanded sheet made of nickel, having a thickness of 1.5 mm, abutting against the resilient layer.

The porous sheet has been interposed between the activated nickel wire and the membrane and then the cell has been closed so that the membrane, the porous sheet, the activated screen and the resilient layer are pressed against the anode by the cathode current collector.

The cell has been operated together with a reference cell identical to the test cell, which was not provided with the porous sheet. The operating conditions were as follows:

| | |
|---|---|
| brine concentration at the anode compartment inlet | 300 g/l of NaCl |
| brine concentration at the anode compartment outlet | 220 g/l of NaCl |
| anolyte temperature | 80° C. |
| anolyte pH | 4 |

-continued

| | |
|---|---|
| catholyte concentration | 30% by weight of NaOH |
| current density | 3000 A/m$^2$ |

Under stabilized operating conditions, a voltage of 3.63 V was detected at the test cell, while the reference cell operated at a voltage of 4.0 V.

EXAMPLE 2

A thin nickel mesh knitted with a nickel wire having a diameter of 0.15 mm, having 25 meshes per cm, has been pickled in HNO3 at 50% by weight for 10 minutes at ambient temperature.

A mixture of aluminum, amorphous carbon and quartz (SiO2), having a grain size comprised between 90 and 170 micrometers, and a composition by weight of Al (30%), C (30%) and SiO2 (40%) has been sprayed onto the pickled nickel mesh by means of a plasma jet torch, operating at the following conditions:

| | |
|---|---|
| carrier gas | oxygen |
| combustible gas (gaseous fuel) | acetylene |
| oxygen pressure | 1.1 bar |
| acetylene pressure | 0.68 bar |
| distance from the torch of the nickel screen | 20–30 cm |

After coating, the weight of the nickel screen was increased by 120%.

The coated screen was soaked in caustic soda at 25% by weight for one hour in order to leach the aluminum deposited together with carbon and quartz.

After leaching the residual weight increase of the nickel mesh was 70%. The porosity was about 35% with an average pore diameter of about 60 micrometers.

In a second test cell, identical to the cell described in Example 1, the nickel screen prepared as aforesaid, has been interposed between the cathodic surface of the membrane and the activated nickel screen of the cathodic resilient structure.

Under the same operating conditions of Example 1, a cell voltage of 3.48 has been detected in this test cell.

EXAMPLE 3

According to the procedure described in Example 2, various porous sheets have been prepared varying the deposit composition, the number of layers and the weight increase of the nickel supporting structures.

The characteristics of the porous sheets prepared are reported in the following table, together with the relative cell voltages detected under the same operating conditions described in Example 1.

| Characteristics of the porous layer | | | | |
|---|---|---|---|---|
| Metal Support | Composition by weight of coating by plasma jet deposition: First layer | Second layer | Residual Increase % by weight after leaching of leachable metal | Cell Voltage V |
| Pickled and sandblasted nickel mesh 25 meshes per inch | Ni (50%) + Graphite (50%) | Al (30%) Amorphous carbon (30%) $SiO_2$ (40%) | 105% | 3.55 |
| " | " | Al (20%) Amorphous carbon (30%) $SiO_2$ (25%) $TiO_2$ (25%) | 115% | 3.40 |

-continued

| Characteristics of the porous layer | | | | |
|---|---|---|---|---|
| Metal Support | Composition by weight of coating by plasma jet deposition: First layer | Second layer | Residual Increase % by weight after leaching of leachable metal | Cell Voltage V |
| " | " | Al(20%) Amorphous carbon (20%) $ZrO_2$ (40%) (Ni—Al) (20%) | 118% | 3.45 |
| " | " | Al (20%) Amorphous carbon (20%) $ZrO_2$ (50%) $Y_2O_3$ (10%) | 116% | 3.46 |
| " | " | Al (20%) Amorphous carbon (20%) $Ta_2O_5$ (60%) | 113% | 3.53 |
| " | " | Al (20%) Amorphous carbon (20%) $Nb_2O_5$ (55%) $PrO_2$ (5%) | 115% | 3.46 |

The above examples clearly show that by utilizing the thin porous sheet of the present invention, operating at 3 kA/m2, a reduction of 0.6 V is obtained in overall cell voltage compared with the values obtained utilizing conventional untreated membranes.

The improvement in the cell voltage is even better than that obtained by prior art cells as disclosed by U.K. Publication GB No. 2,064,586. In fact in Example 1 of said publication it is stated that a cell voltage of 3.11 V is obtained with the treated membranes of the invention and 3.65 V is obtained with conventional untreated membranes, that is a maximum cell voltage reduction of 0.54 V is achieved with respect to the values obtained utilizing conventional membranes not subjected to any treatment.

We claim:

1. Electrolytic cell for the production of chlorine by electrolysis of alkali metal chloride solutions, comprising at least one gas and liquid permeable anode and at least one gas and liquid permeable cathode pressed against and separated by a cation exchange membrane substantially impervious to hydrodynamic flow, wherein a permeable, hydrophilic and coated substantially non-conductive sheet is interposed between the cathode and the membrane, said sheet comprising a support coated with a hydrophilic material exhibiting high electrical resistivity and capable of withstanding the caustic solution conditions.

2. The cell of claim 1 wherein the thickness of said sheet is not greater than 1 mm and the pore size is comprised between 10 and 300 micrometers.

3. The cell of claim 1, wherein said hydrophilic material is at least one of those belonging to the group of $Y_2O_3$, $La_2O_3$, $Ce_{02}$, $PrO_2$, $NdO_2$, $TiO_2$, $ZiO_2$, $HfO_2$, $ThO_2$, $Nb_2O_5$, $Ta_2O_5$ and asbestos.

4. The cell of claim 1 characterized in that said hydrophilic material is at least one material belonging to the group of: CaO, BaO, SrO, Y2O3, La2O3, CeO2, PrO2, NdO2, TiO2, ZrO2, HfO2, ThO2, V2O5, Nb2O5, Ta2O5, MoO3, WO3, CdO, Al2O3, SiO2, mixed oxides of the same metals, amorphous carbon, and asbestos.

5. The cell of claim 2 characterized in that said hydrophillic material is 50 to 500 micrometers thick and has an average pore size of 10 to 300 micrometers.

6. The cell of claim 1 characterized in that said sheet is 0.1 to 0.6 millimeters thick and has an average pore size of 10 to 300 micrometers.

7. The cell of claim 1 wherein said film is applied only onto the surface of said sheet that faces said membrane.

8. The cell of claim 1 wherein said film is applied to said sheet by plasma jet deposition.

9. The cell of claim 1 wherein said sheet is selected from the group of nickel, copper, and stainless steel.

10. The cell of claim 1 wherein said sheet is nickel.

* * * * *